US005678655A

United States Patent [19]

Bearden

[11] Patent Number: 5,678,655

[45] Date of Patent: Oct. 21, 1997

[54] VARIABLE HEIGHT PORTABLE SCAFFOLDING SYSTEM

[76] Inventor: David G. Bearden, 516 N. Main St., Carthage, Tenn. 37030

[21] Appl. No.: 572,568

[22] Filed: Dec. 14, 1995

[51] Int. Cl.[6] ..... E04G 1/00

[52] U.S. Cl. ..... 182/181; 182/151

[58] Field of Search ..... 182/118, 151, 182/181, 182, 183, 184, 185, 186, 224, 225, 226, 227

[56] References Cited

U.S. PATENT DOCUMENTS

| | | | |
|---|---|---|---|
| 616,762 | 12/1898 | Bell | 182/225 X |
| 936,945 | 10/1909 | Rice | 182/185 |
| 1,542,048 | 6/1925 | Forester | 182/185 |
| 1,710,644 | 4/1929 | Hilton | 182/184 |
| 2,400,659 | 5/1946 | St-Mars . | |
| 2,416,950 | 3/1947 | Pohrman . | |
| 2,634,172 | 4/1953 | Hollidge | 182/181 |
| 2,829,927 | 4/1958 | Sword | 182/181 |
| 4,008,786 | 2/1977 | Canavan . | |
| 4,071,113 | 1/1978 | Pelser | 182/181 |
| 4,248,326 | 2/1981 | Hansen et al. . | |
| 4,836,333 | 6/1989 | Twigger | 182/186 |
| 4,938,311 | 7/1990 | Combs | 182/181 X |

FOREIGN PATENT DOCUMENTS

| | | | |
|---|---|---|---|
| 668595 | 3/1952 | United Kingdom | 182/181 |
| 762839 | 12/1956 | United Kingdom | 182/181 |
| 2183281 | 6/1987 | United Kingdom | 182/184 |
| 90/05819 | 5/1990 | WIPO | 182/184 |

*Primary Examiner*—Alvin C. Chin-Shue
*Assistant Examiner*—Richard M. Smith
*Attorney, Agent, or Firm*—Jacobson, Price, Holman & Stern, PLLC

[57] ABSTRACT

An improved, variable height, portable scaffold support that when used in pairs with a conventional board of standard size forms a horizontal working platform. The support has a series of opposing plates that allow insertion of a board at variable working heights. The opposing plates also provide a configuration that fixes the board and support in the correct working position so that the support does not need to be repositioned each time the support system is relocated, even when no auxiliary fasteners are used. The support base is of sufficient size to permit use of the support on a soft surface such as sand or grass.

3 Claims, 2 Drawing Sheets

VARIABLE HEIGHT PORTABLE SCAFFOLDING SYSTEM

BACKGROUND OF THE INVENTION

This invention relates to a portable scaffolding support system designed to provide a stable working platform with variable working heights utilizing a board of conventional size when joined with a support on each end of the board.

Scaffolds are used for a variety of purposes in building, construction and general repairs. Ordinarily, most portable scaffolding is comprised of makeshift systems using carpenter's sawhorses, stacks of concrete blocks or ladders with a board placed on top to construct a working platform.

When these types of temporary scaffolding are used, they are cumbersome to construct and difficult to relocate. These types of temporary systems do not provide a way to move an assembled scaffold system easily from one location to another.

The known prior art fails to provide a scaffold system that when assembled will retain the correct working position of the supports in relation to the board when being moved around the work site without the use of auxiliary fasteners. A partial solution to the problem of maintaining the correct working position of the scaffold supports when being relocated is shown in U.S. Pat. No. 4,008,786 to Canavan. Canavan's support shows holes, through a bar in the support that allows multiple screws to be inserted through the bar and into the board to join the board and support together. This however, will increase the amount of time that is required for assembly and disassembly and will require the use of tools for the insertion and removal of the screws each time the support system is assembled or disassembled. Also, with repeated use, the threads of the screws will ream out a hole in the wood and be unable to hold the board and support together in a secure manner.

Previous scaffold systems have attempted to meet the need for a system that is easy to use, assemble, and disassemble. The relevant prior art has tried to accomplish this with various designs and configurations, but with limited success.

When using a portable scaffold system, the degree of safety and stability should be a major consideration. Numerous supports in the prior art attempt to secure a board into the support system by way of binding by friction or by creating indentions into the board being used, as shown in U.S. Pat. No. 4,008,786 to Canavan and U.S. Pat. No. 4,248,326 to Hansen. To create these indentions as described in the above patents to Canavan and Hansen, the board is placed between two parallel bars in each support and the bottom of the legs in the supports are placed in a diverging angle in relationship to the board to force the edges of the bars into the board's surface when a downward pressure is applied. These types of devices attempt to stabilize the system and avoid a sliding movement between the board and the supports.

These methods of binding the board are inadequate because the amount of the binding force is in a direct relationship to the weight of the user. This binding force which attempts to create indentions in the board is also directly related to the density of the board used. Therefore, a person that is not of sufficient weight, coupled with a board of high density would not be able to generate enough binding force to adequately stabilize the system.

When the binding force between the supports and the board is inadequate, a sliding type motion occurs with repeated use. When this sliding motion occurs, it can allow the support to work off the end of the board causing a collapse of the system.

Most often, a portable scaffolding system is used at a construction site under various working conditions. The stability of the scaffolding is a major factor in safety. The prior art has provided systems consisting of two legs per support, with one support on each end of the board. These types of configurations provide a very limited surface area of contact between the support legs and the floor or surface the support system is resting upon. When only one leg of a support shifts off the stable surface it is resting upon, as when a leg slips from a firm surface into sand, the system can twist or collapse, possibly resulting in bodily injury to the worker. Unfortunately, the prior art has not addressed this problem and the safety risks it poses for the workers using these types of support systems.

Numerous portable scaffold support systems in the prior art that do not use auxiliary fasteners, reveal that each time the system is relocated, the supports lose their binding capacity when the angle of the supports that produce the binding force is changed. Therefore, each time the support system is relocated, the supports, in relationship to the board, have to be repositioned to again provide stability in the system.

SUMMARY OF THE INVENTION

In view of the previously listed factors, it is an object of the present invention to provide a portable scaffolding system including supports and a board. The scaffolding system is arranged such that a desired working position of the supports is maintained with respect to the board when the system is being relocated, with this being accomplished with or without the use of auxiliary fasteners. The ability of this system to retain the proper positioning of a support results from a series of plates with an enlarged surface area which contacts the superior and inferior surfaces of the board and which fixes the board and support in the correct working position. When a worker does not need to reposition the supports each time the support system is relocated, there is an inherent safety factor within this support system that will increase the workers safety due to a reduction in the possibility of human error associated with repositioning of the supports.

It is a further object to provide an improved portable scaffold system that eliminates the need for the binding force that was necessary in the prior art to combine the board and two supports into a working system. This support system provides a method of locking the board and supports together by using only one locking pin per support. This is accomplished in the following manner. Prior to insertion of a locking pin, a hole is drilled in each end of the board to be used. After the board is placed into a support, the locking pin is inserted to lock the support and board together. The hole in each end of the board has to be made only one time. After the holes are initially drilled, one in each end of the board, the system can be assembled or disassembled without the use of any tools by simply inserting or removing the locking pin. The ease with which assembly and disassembly can be accomplished will save the worker time. This method of locking the support system together will also increase the workers safety by not having screws ream out the wood over repeated use, which, in turn, would decrease the screws holding capacity.

It is a further object of this system to provide a portable scaffolding system capable of use on a soft surface, such as sand or grass. This is accomplished by substantially increasing the surface area of the base of the supports in contact with the surface upon which the system is resting. The limited support surfaces shown in the prior art are inadequate for use on soft surfaces and thereby restrict their use. The improved stability in this system reduces the rocking or twisting motion of the scaffold system when used on a soft surface, thereby increasing the safety to the worker.

Further objects and advantages of this scaffolding system will become apparent from consideration of the drawings and following description:

DESCRIPTION OF THE PREFERRED EMBODIMENTS

Figure 1:
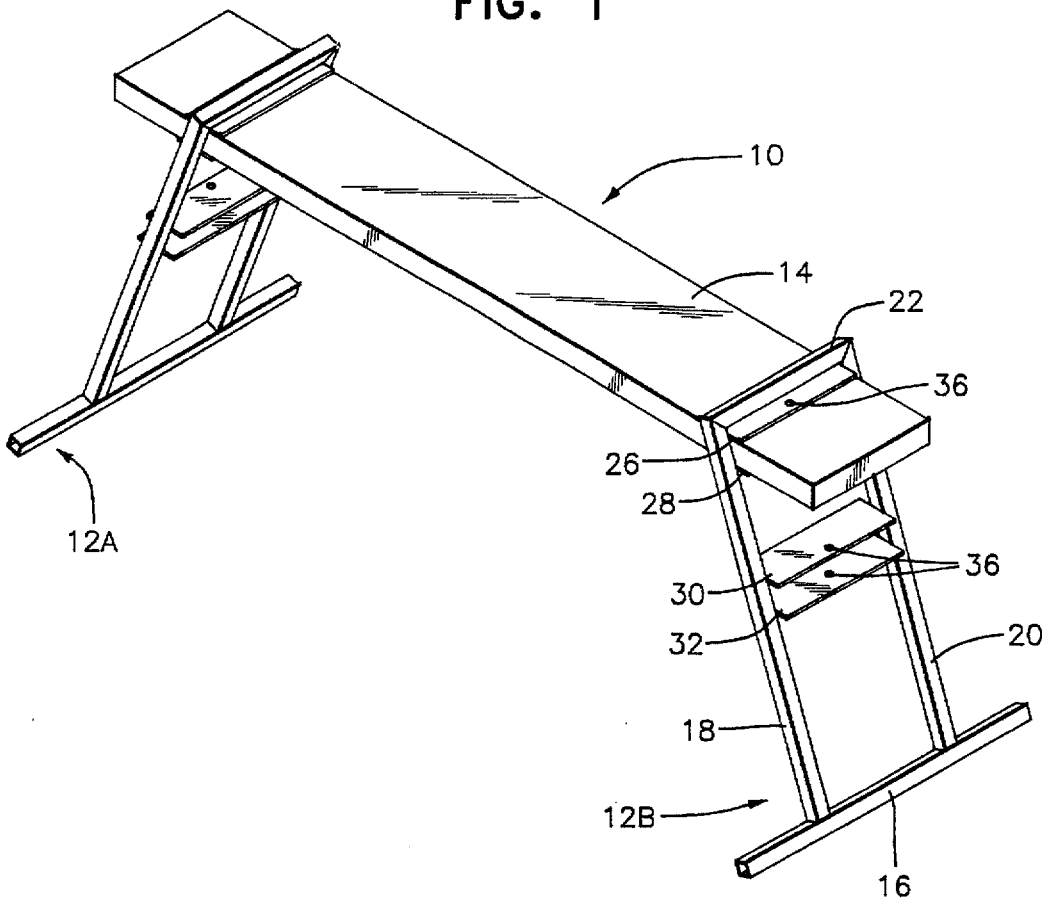
FIG. 1 is a perspective view of a scaffolding system in the working position, which system includes a pair of supports and a board.

A preferred embodiment of this scaffold system is illustrated in FIG. 1 in accordance with the present invention. FIG. 1 shows a scaffold system 10 consisting of a pair of supports 12A and 12B spanned by a board 14.

Figure 2:
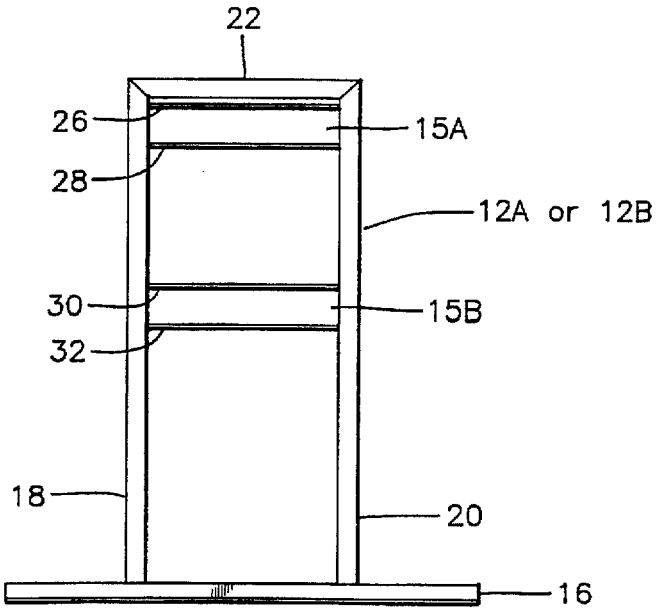
FIG. 2 is a frontal view of a support shown in FIG. 1.
Figure 3:
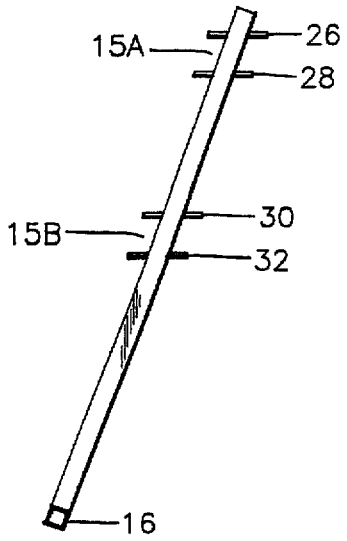
FIG. 3 is a side view of the support.

FIG. 2 is a frontal view of the support consisting of a support base 16, two upright stanchions 18 and 20, a header 22, plates 26, 28, 30 and 32. FIG. 1 shows a bore 36 in each plate. (All bores are not shown) The support base 16, stanchions 18 and 20, and header 22 are preferably welded at their intersections to define a frame. As shown in FIG. 2, the support base is preferably welded to the stanchions so that there is an equal length of the support base extending laterally from the lateral side of each stanchion. Plates 26, 28, 30, and 32 are welded to the medial surfaces of the stanchions to create openings 15A and 15B which securely accommodate the board 14 to form the scaffold system. In FIGS. 2 and 3, opening 15A is formed by the opposing surfaces of plates 26 and 28, and the medial surfaces of the stanchions. Opening 15B is formed by the opposing surfaces of plates 30 and 32 and the medial surfaces of the stanchions.

Figure 4A:
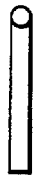
FIGS. 4A and 4B are orthogonally related views of a locking pin.
Figure 4B:
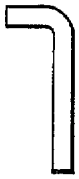
Figure 5:
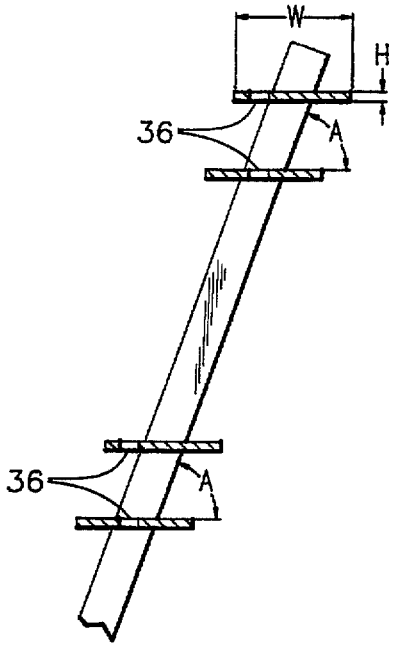
FIG. 5 is a partial cross sectional view of the support showing details of a preferred embodiment of the plates and the angle A.
Figure 6:
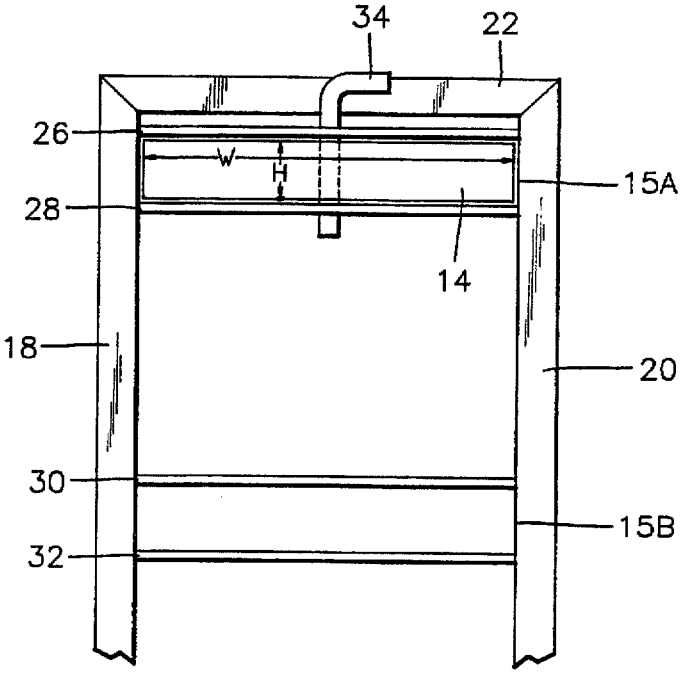
FIG. 6 is a partial frontal view showing the board 14 inserted into the scaffold support with a locking pin in place.

FIGS. 4A and 4B show a locking pin. FIG. 5 shows the preferred working angle of all the plates designated by the angle A. In FIG. 6, plate 26 is preferably welded to the medial surfaces of the stanchions at angle A, which is shown in FIG. 5. Plate 28 is also preferably welded to the medial surfaces of the stanchions at the same angle A so that opening 15A is only slightly greater in height and width than the height and width, respectively, of the board 14. Plates 30 and 32 are welded in a like manner as plates 26 and 28 at the desired alternate working height.

Figure 7:
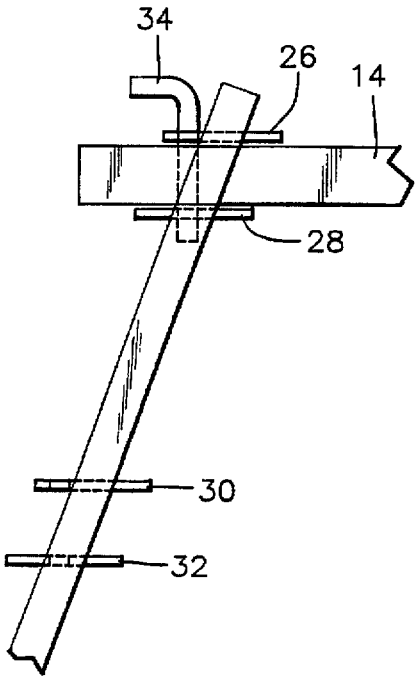
FIG. 7 is a side view of FIG. 6 showing how the locking pin interconnects the support and board.

As shown in FIGS. 5 and 7, the width of the plates creates a sufficient surface area to preclude torquing or rotation of the support when the board is inserted into the support. When the support cannot torque or rotate, the need to reposition the support each time the system is relocated is eliminated, even when no auxiliary fastening devices are used. In the known prior art which did not use auxiliary fastening devices, the supports had to be repositioned in a diverging or oblique angle each time the system was moved to regain the system's stability.

Referring now to FIG. 1, a bore 36 is made in each plate and is centered between the stanchions (not all bores are shown). In FIG. 5, the same bores shown in FIG. 1 are made in each plate in an offset manner which, in turn, allows vertical insertion of the locking pin 34.

A hole is drilled in the center of each end of the board, using the same diameter as the bores in each plate. (The holes in the board are not shown) The holes in the board allow insertion of the locking pin as shown in FIGS. 6 and 7.

In the preferred embodiment of this scaffold system the support base, stanchions and header are composed of tubular metal. Plates 26, 28, 30 and 32 are preferably composed of metal plates. Also, in the preferred embodiment, angle A may be selectively chosen between 65 and 85 degrees and is most preferable between 70 and 80 degrees. The locking pin is preferably composed of rigid metal.

In operation, this portable scaffold system is assembled and used in the following manner:

To assemble the system, the user grasps a support in one hand, and the board is then inserted into either opening 15A or 15B with the other hand. This process is then repeated with the other support on the opposite end of the board to form the scaffold system. To insert the locking pin, a hole must be drilled in each end of the board, preferably using the same diameter as bore 36. When the scaffold system is assembled and the locking pins have been inserted to lock the system together, the scaffold system can be picked up and moved to the desired area of work by one person. The working platform can be varied in height by placing the board into either one of the openings 15A or 15B to obtain the correct working height according to the task being performed.

This scaffold system is designed to be used on a stable surface such as a wood floor or a concrete floor, but is also adapted for use on a soft surface such as sand or grass. The ability of this scaffold system to be used on a soft surface such as sand or grass, is directly attributed to the stability provided by the substantial surface area that the support base 16 provides when it contacts the surface upon which it is resting. When using this scaffold system, the user may want to have several lengths of boards already drilled to expedite the process of changing the length of board used. When several lengths of boards are available, the user is able to quickly change the length of the board to adapt the system to the size needed for the work being performed. The ability to adapt the length of this system to the size of the job being performed will save the worker time and will reduce the number of times the support system has to be relocated to complete the job, especially when compared to using a ladder which must be moved several times to accomplish the same task that this system accomplishes upon the initial set up.

Although the foregoing description includes a description of preferred embodiments of the present invention, it is understood that the invention is not limited to the illustrated embodiments. It is also understood that the term "board" may broadly encompass any beam-like element, and is not limited to beams made of wood. The board therefore may consist of virtually any sturdy material.

Similarly, the plates could be made of expanded metal, the openings between the plates and stanchions could be smaller or larger to accommodate various board sizes, the support base could be made of a plate instead of a tubular bar and may be joined to the stanchions at the same angle as the plates are (at angle A), the support base may be made smaller or larger, and more openings may be added to thus allow a greater variety of working heights.

I claim:

1. A support for stabilizing one end of a board to form a horizontal working platform with the support comprised of:

an elongated metal tube to form a support base;

two stanchions or elongated metal tubes which are spaced apart and joined perpendicularly to said support base at an equal distance from the center of said support base, the spacing being greater than the width of said board;

an elongated metal tube that forms a header, said header joining the upper ends of said stanchions together so that said stanchions are spaced parallel to each other and are joined to said support base and said header;

a first pair of metal plates which are joined to the medial surfaces of said stanchions where said plates are substantially parallel to each other and define an angle with respect to the longitudinal axis of said stanchions, wherein said angle may vary between 65 and 85 degrees and a second pair of metal plates are joined in a like manner to the first pair of plates between said header and said support base to accept said board at an alternate working height, said first and second pairs of plates being joined to said stanchions, each pair of plates being spaced apart a distance greater than the thickness of said board;

a bore in each of said plates centered between said stanchions, wherein said bores are offset from one another within respective pairs of parallel plates whereby a locking pin can be inserted vertically to lock said support and said board together.

2. The support claimed in claim 1, wherein:

said plates are of a sufficient width that when said board is inserted between one of said pairs of substantially parallel plates, the width of said plates will not allow torquing or rotation of said support in relation to said board to occur, whereby the proper working position of said support in relation to said board is retained without requiring auxiliary fastening devices or repositioning of the support in a diverging or oblique angle each time the system is relocated.

3. The support claimed in claim 1 wherein:

said support base is wider than the spacing between said stanchions and includes opposite ends which extend laterally beyond said stanchions, thereby decreasing twisting or rocking movement and retaining stability.

* * * * *